United States Patent [19]

Day

[11] Patent Number: 4,996,467

[45] Date of Patent: Feb. 26, 1991

[54] GARBAGE CONTAINER

[76] Inventor: Jong-Yih Day, 5F No. 5-1, Alley 62, Lane 166, Shih-Pai Rd., Taipei, Taiwan

[21] Appl. No.: 454,993

[22] Filed: Dec. 22, 1989

[51] Int. Cl.[5] ..... E05F 15/20

[52] U.S. Cl. ..... 318/480; 318/283; 318/285; 49/25; 49/31

[58] Field of Search ..... 318/16, 264, 265, 266, 318/267, 283, 285, 286, 466, 468, 480, 558; 49/25, 31; 100/53, 229 A, 256, 295; 414/406, 421

[56] References Cited

U.S. PATENT DOCUMENTS 4,552,061 11/1985 Brutsman ..... 100/229 A X

FOREIGN PATENT DOCUMENTS 2486140 1/1982 France ..... 49/25

*Primary Examiner*—Bentsu Ro

*Attorney, Agent, or Firm*—Michael L. Keller

[57] ABSTRACT

A garbage container is disclosed, which will open automatically when a user is present in front of the container and will close after a predetermined time of the departure of the user. This garbage container comprises an infrared ray transmitter and an infrared ray receiver to detect the presence of a user.

2 Claims, 1 Drawing Sheet

GARBAGE CONTAINER

FIELD OF THE INVENTION

The present invention relates to a garbage container, and in particular to a garbage container whose cover can be opened automatically if a user is present in front of the garbage container.

BACKGROUND OF THE INVENTION

Conventional garbage containers can be roughly classified into two types. The first type is an open garbage container. That is, no cover is provided for the garbage container, and therefore quite unhygienic. The second type is a cover-provided garbage container. With this type, the user must open the cover when he dumps the garbage into the container, and its is therefore inconvenient to use.

SUMMARY OF THE INVENTION

It is therefore an object of the present invention to provide a garbage container whose cover will open automatically if a user is presented in front of the container and whose cover will close automatically after a predetermined time of the departure of the user.

In order to attain this object, the garbage container of the present invention comprises: a container body having an opening; a cover for covering the opening; a stepping motor mounted on the container body, having an output shaft capable of rotating in both clockwise and counterclockwise directions; a rotor fixed on the output shaft of the motor; a control rope with one end fixed on the cover and the other end fixed and partially wound on the rotor; an infrared ray transmitter for transmitting infrared ray to detect the presence of a user; an infrared ray receiver for receiving the infrared ray reflected back and sending out a first signal and a second signal; a first actuating circuit for receiving the first signal from the infrared ray receiver to actuate the monitor to rotate the output shaft in a clockwise direction; a second actuating circuit for receiving the second signal from the infrared ray receiver to actuate the motor to rotate in the output shaft in a counterclockwise direction; a delay circuit connecting the infrared ray receiver and the second actuating circuit for delaying the second signal received from the infrared red receiver.

BRIEF DESCRIPTION OF THE DRAWING

This invention will be more fully understood from the following description, taken in connection with the accompanying drawing in which.

DETAILED DESCRIPTION OF THE PREFERRED EMBODIMENT

Figure 1:
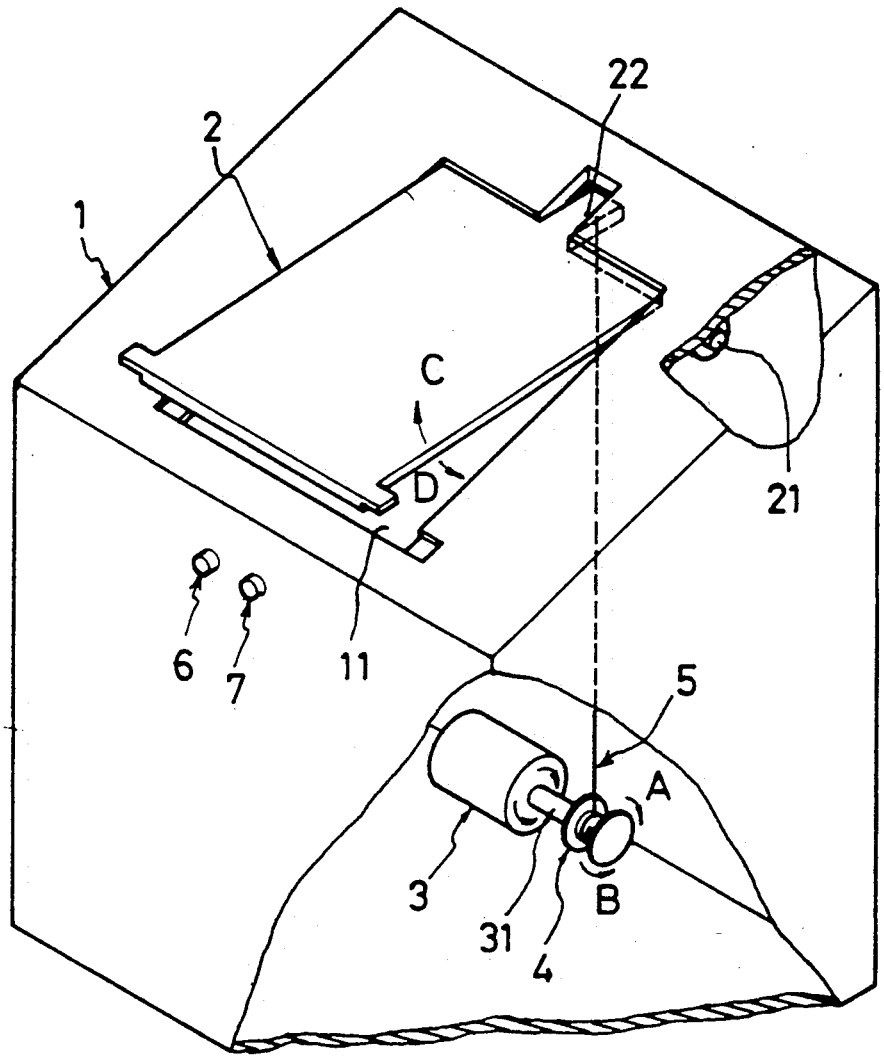
FIG. 1 is a preferred embodiment of the garbage container of the present invention.

Refer to FIG. 1 , a preferred embodiment of the garbage container of the present invention. As shown in FIG. 1, the garbage container body 1 has an opening 11 provided on the top of the garbage container body, and from which the garbage is put into. A lid 2 is provided for closing the opening 11, and is pivoted onto a pivot axis 21 which is mounted on the backside of the opening 11 so that the lid 2 is openable from the front side of the garbage container. At the backside of the lid 2 is extended out an extending portion 22. A stepping motor 3 is mounted at the bottom of the garbage container and has an output shaft 31. The output shaft 31 of the stepping motor 3 is capable of rotating in both clockwise direction and counterclockwise direction. The output shaft 31 is connected to a rotor 4. A control rope 5 is fixed onto the rotor 4 with its one end and its another end is connected to the extending portion 22 of the lid 2 so that when the stepping motor 3 is actutated the lid 2 will be opened or closed by the extending portion 22 through the control rope 5 fixed on the rotor 3. An infrared ray transmitter 6 is mounted on the front of the garbage container body 1 for transmitting infrared ray to detect the presence of a user, and an infrared ray receiver 7 is mounted beside the infrared ray transmiter 6 for receiving the infrared ray reflected back from the user when a user is present. This infrared receiver 7 can send out a first signal S1 and a second signal S2. The first signal S1 will be sent to a first actuating circuit (not shown in FIG. 1) which connects the infrared ray receiver 7 and the stepping motor 3 to make the stepping motor 3 rotate in a clockwise direction, so as to open the lid 2 of the garbage container through the control rope 5. The second signal S2 will be sent to a second actuating circuit (not shown in FIG. 1) which connects the infrared ray receiver 7 to the stepping motor 3 via a delay circuit (also not shown in FIG. 1) to make the stepping motor 3 rotate in a counterclockwise direction after a time delay (for example 30 seconds) so as to close the lid 2 of the garbage container after the user's departure.

By the aforementioned construction, when a user is standing in front of the garbage container, the infrared ray emitted by the infrared ray emitter 6 will be reflected to the infrared ray receiver 7, and two signals S1 and S2 will therefore be sent out. The first signal S1 is fed into the first actuating circuit 8 to make the stepping motor 3 rotate a predetermined angle in a clockwise direction and thus the rotor 4 will rotate a corresponding angle in the direction of arrow A so as to make the lid 2 rotate in the direction of arrow C to open the lid through the control rope 5. Meanwhile, the second signal S2 is fed into the second actuating circuit 9 through the delay circuit to make the stepping motor 3 rotate a predetermined angle after a time delay (for example 30 seconds) in a counterclockwise direction and, thus the rotor 4 will rotate in a corresponding angle in the direction of arrow B so as to make the lid 2 rotate in the direction of arrow D to close the lid 2 through the control rope 5.

While the invention has been described in terms of what is presently cconsidered to be the most practical and preferred embodiment, it is to be understood that the invention need not be limited to the disclosed embodiment. On the contrary, it is intended to cover various modifications and similar arrangements included within the spirit and scope of the appended claims, the scope of which should be accorded to the broadest interpretation so as to encompass all such modifications and similar structures.

What is claimed is:

1. A garbage container comprising:

a container body having an opening;

a cover for covering said opening; a motor mounted on said container body, having an output shaft capable of rotating in both clockwise and counterclockwise directions;

a rotor fixed on said output shaft of said motor;

a control rope with one end fixed on said cover and the other end fixed and partially wound on said rotor;

an infrared ray transmitter for transmitting infrared ray to detect the presence of a user;

An infrared ray receiver for receiving the infrared ray reflected back and sending out a first signal and a second signal;

a first actuating circuit for receiving said first signal from said infrared ray receiver to actuate said motor to rotate said output shaft in a clockwise direction;

a second actuating circuit for receiving said second signal from said infrared ray receiver to actuate said motor to rotate said output shaft in a counter-clockwise direction; a delay circuit connecting said infrared ray receiver and said second actuating circuit for delaying said second signal received from said infrared ray receiver so that when a user is present in front of said garbage container, said cover will open automatically and will close automatically after a predetermined time of the departure of the user.

2. A garbage container as claimed in claim 1, wherein said motor is a stepping motor.

* * * * *